United States Patent [19]

Burchett

[11] Patent Number: 4,565,527

[45] Date of Patent: Jan. 21, 1986

[54] METHOD AND APPARATUS FOR TRAINING A HUMAN BY FEEDBACK ENHANCED LEARNING

[76] Inventor: Barry L. Burchett, 11 Cavalier Dr., Huntington, W. Va. 25701

[21] Appl. No.: 683,047

[22] Filed: Dec. 18, 1984

Related U.S. Application Data

[63] Continuation of Ser. No. 464,722, Feb. 7, 1983, abandoned.

[51] Int. Cl.[4] ..... A63B 69/00

[52] U.S. Cl. ..... 434/248; 273/1.5 A; 273/371

[58] Field of Search ..... 73/DIG. 11; 273/1.5 A, 273/25, 371, DIG. 27; 434/247, 248, 249, 251, 258

[56] References Cited

U.S. PATENT DOCUMENTS

| | | | |
|---|---|---|---|
| 3,094,330 | 6/1963 | Smith | 434/249 X |
| 3,097,303 | 7/1963 | Ulrich | 273/371 X |
| 3,105,685 | 10/1963 | Jahn | 434/249 X |
| 3,229,975 | 1/1966 | Tompkins | 273/371 X |
| 4,021,036 | 5/1977 | Nelson | 434/247 X |
| 4,023,798 | 5/1977 | Pronin | 434/247 X |
| 4,212,116 | 7/1980 | Hajduch | 273/DIG. 27 X |

OTHER PUBLICATIONS

Elizabeth M. Mortimer, "Basketball Shooting", pp. 234–243 of the Research Quarterly for May 1951.

*Primary Examiner*—Harland S. Skogquist
*Attorney, Agent, or Firm*—Frank C. Leach, Jr.

[57] ABSTRACT

A sensing frame is positioned so that a basketball will pass through a rectangular shaped opening in the sensing frame when a free throw shooter shoots the basketball towards a goal. The sensing frame has a beam of light directed across it above the top of the desired path of the basketball for the basketball to enter the goal and a second beam of light directed across it below the desired path of the basketball to enter the goal. If either of these beams of light is broken, different alarm signals indicate to the shooter whether the path of the basketball is high or low. The sensing frame is adjustable both vertically and about a horizontal axis to enable the desired positioning of the sensing frame relative to the shooter.

20 Claims, 7 Drawing Figures

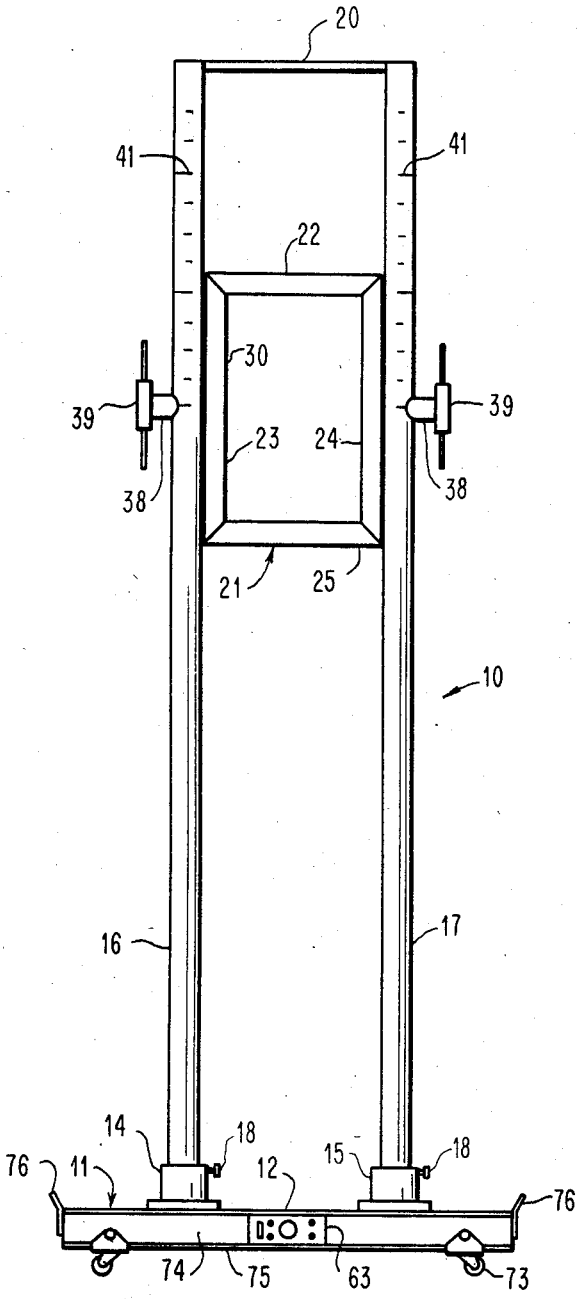
FIG. 1
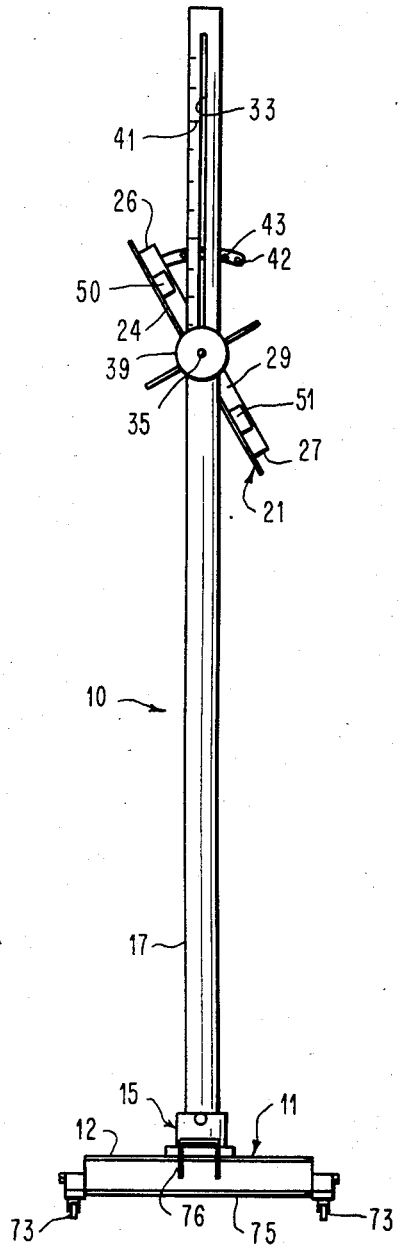
FIG. 2
FIG. 7
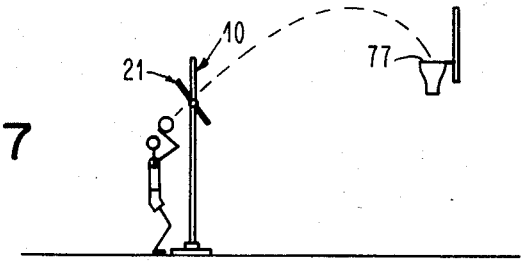

METHOD AND APPARATUS FOR TRAINING A HUMAN BY FEEDBACK ENHANCED LEARNING

This is a continuation of application Ser. No. 464,722, filed Feb. 7, 1983, and now abandoned.

This invention relates to a method and apparatus for training a human by feedback enhanced learning and, more particularly, to a method and apparatus for training a human to direct an object along a desired path.

In aiming a basketball at a goal, there are three parameters to be considered by the brain of the shooter. These are the direction of the basketball, the trajectory of the basketball, and the velocity of the basketball. Each of these parameters must be fine tuned by the shooter in order for the basketball to enter the goal.

While these parameters differ depending on the location of the shooter, the one location in which there is a fixed distance from the goal is when free throws are shot from the free throw line since this is a fixed distance from the goal. At the free throw line, the shooter should be able to make a relatively high percentage of shots because the parameters are the same each time.

Because of the limited proprioceptive feedback from the muscles to the brain, it is difficult for the brain to fine tune the trajectory, in particular, of the basketball in its flight from the shooter to the goal. This inconsistency of the arc of the trajectory is a major cause of poor free throw shooting.

The trajectory is either too high or too low from a desired flight path that will cause the basketball to enter the goal. Thus, if the basketball is above the desired flight path, then the shooter must lower the trajectory. If the basketball is below the desired flight path, the trajectory must be raised.

The method and apparatus of the present invention enables a free throw shooter to be trained to obtain the desired flight path of the basketball when it is propelled towards the goal by the shooter. The apparatus of the present invention preferably employs the free throw line as the standard distance for training purposes because of its fixed location. The apparatus of the present invention senses when the basketball is above or below the desired flight path and produces a signal with the signals being different depending upon whether the basketball is above or below the desired flight path. With this signal, the shooter can learn to change the trajectory of the basketball so that the basketball will have the desired flight path.

Because each shooter has a different trajectory as this depends upon various factors including the shooter's height, for example, it is necessary for the apparatus to be capable of being adjustable as to its position both vertically and horizontally from the shooter. The apparatus of the present invention accomplishes this through providing an adjustable sensing frame.

An object of this invention is to provide a method and apparatus for training a human by feedback enhanced learning.

Another object of this invention is to provide a method and apparatus for training a human to direct an object along a desired path.

A further object of this invention is to provide a method and apparatus for sensing when a human directed object is not traveling along a desired path.

Still another object of this invention is to provide a method and apparatus for training a basketball player to shoot free throws and consequently to improve the player's general shooting accuracy.

Other objects of this invention will be readily perceived from the following description, claims, and drawings.

This invention relates to a method of improving the learning of a motor skill by identifying a specific, critical parameter of the motor skill in which proprioception provides the primary feedback and then enhancing the specificity of this available feedback including determining when the specific, critical parameter of the motor skill is satisfactory and not satisfactory with artificial sensors and relaying information by nonproprioceptive channels to the brain from the artificial sensors in accordance with whether the specific, critical parameter of the motor skill is satisfactory or not satisfactory.

This invention also relates to a method of training a human to direct an object along a desired path including determining the desired path for the directed object by having the human direct the object along the desired path and automatically indicating to the human directing the object when the directed object is removed from the desired path by at least a first selected amount at a first selected distance from where the object is directed.

This invention further relates to an apparatus for training a human to direct an object along a desired path by indicating when the directed object is not on the desired path including first sensing means disposed a first amount from the desired path at a first selected distance from where the object is directed and first signaling means to produce a first signal when the first sensing means senses the directed object is at least the first selected amount from the desired path at the first selected distance from where the object is directed.

The attached drawings illustrate a preferred embodiment of the invention, in which:

FIG. 1 is a front elevational view of an apparatus for sensing when a basketball is above or below a desired flight path with the sensing frame in its vertical position;

FIG. 2 is a side elevational view of the apparatus of FIG. 1 with the sensing frame in an operative position and taken from the right side of FIG. 1;

FIG. 7 is a schematic view showing the flight path to a basketball goal from a shooter.

Figure 3:
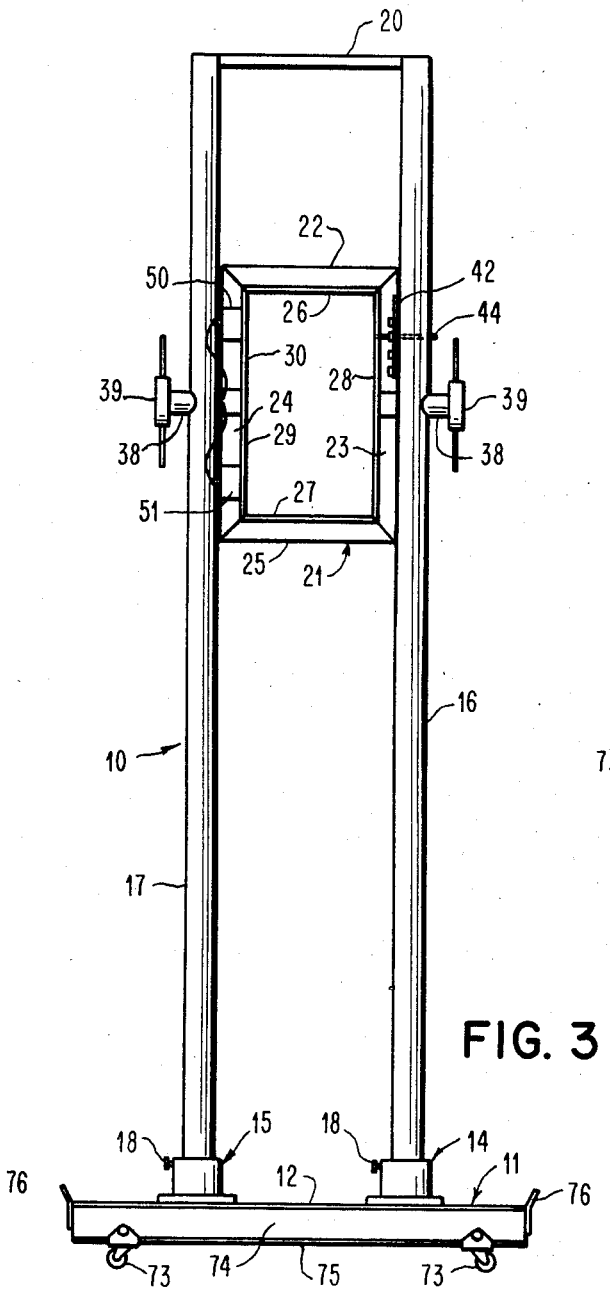
FIG. 3 is a rear elevational view of the apparatus of FIG. 1 with the sensing frame in its vertical position.

Referring to the drawings and particularly FIG. 1, there is shown an apparatus 10 for use in training a free throw shooter to shoot a basketball along a desired flight path to a basketball goal. The apparatus 10 includes a base 11, which is supported on a floor or other structure on which the shooter stands.

The base 11 has an upper plate 12 on which a pair of mounting sockets 14 and 15 is mounted by suitable means such as welding, for example. A vertical pole 16 is disposed in the socket 14 and extends upwardly therefrom . A vertical pole 17 is disposed in the socket 15 and extends upwardly therefrom and substantially parallel to the pole 16. The poles 16 and 17 are retained in the mounting sockets 14 and 15, respectively, by set screws 18.

The upper ends of the poles 16 and 17 are connected to each other by a bar 20. The bar 20 is substantially parallel to the upper plate 12 of the base 11.

A sensing frame 21 is mounted on the poles 16 and 17 for vertical adjustment therealong and pivotal movement about a horizontal axis. The sensing frame 21, which is rectangular shaped, is formed by a top member 22, side members 23 and 24, and a bottom member 25. The top member 22 and the bottom member 25 are substantially parallel to each other and substantially perpendicular to the side members 23 and 24, which are substantially parallel to each other.

As shown in FIG. 3, the top member 22 has a top wall 26 disposed substantially perpendicular thereto and substantially parallel to a bottom wall 27, which extends substantially perpendicular from the bottom member 25. The side member 23 has a side wall 28 substantially perpendicular thereto and substantially parallel to a side wall 29, which is substantially perpendicular to the side member 24. The inner edges of the walls 26–29 define a rectangular shaped opening 30 of the sensing frame 21.

Figure 4:
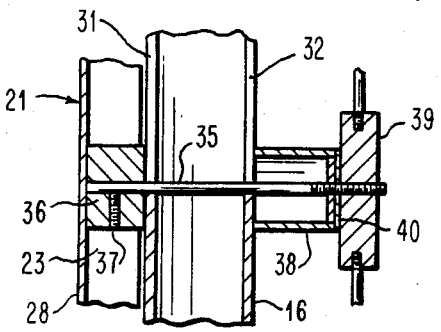
FIG. 4 is a fragmentary sectional view of a mounting arrangement for the sensing frame.

The pole 16, which is annular shaped in cross section, has a pair of vertical slots 31 (see FIG. 4) and 32 formed in diametrical portions thereof. The pole 17, which is annular shaped in cross section, has a similar pair of vertical slots (one shown at 33 in FIG. 2) in diametrical portions thereof.

The vertical slots 31 (see FIG. 4) and 32 receives a rod 35, which has one end attached to the sensing frame 21, for vertical movement therein. One end of the rod 35 extends into a block 36, which is fixed to the side member 23 of the sensing frame 21, and is retained in the block 36 by a set screw 37.

The other end of the rod 35 extends through a hollow body 38 and is secured to a circular locking element 39. The circular locking element 39 bears against one surface of a washer 40, which has its other surface bearing against the outer, closed end of the hollow body 38. Accordingly, the rod 35 can be held in any position to which it is moved along the vertical slots 31 and 32 by tightening the circular locking element 39 against the washer 40 and the hollow body 38.

A similar structure is used with the pole 17 and the vertical slots (one shown at 33 in FIG. 2) therein. Accordingly, tightening of the two circular locking elements 39 (see FIG. 1) positions the sensing frame 21 at any vertical position along the poles 16 and 17 from the bottom of the slots 31 (see FIG. 4) and 32 in the pole 16 and the bottom of the similar slots (one shown at 33 in FIG. 2) in the pole 17.

Each of the poles 16 (see FIG. 1) and 17 has indicia 41 thereon to indicate the vertical position at which the sensing frame 21 has its center disposed. The center of the sensing frame 21 is defined by a horizontal axis through the rods 35 (see FIG. 2).

The sensing frame 21 also is pivotal about the horizontal axis of the rods 35 when each of the circular locking elements 39 is not in a tightened position. Thus, the plane of the sensing frame 21 can be moved from the vertical.

The angular position of the sensing frame 21 can be from 30° to 60° to the horizontal in 10° increments. Of course, any other desired angular adjustment could be employed if desired.

The sensing frame 21 can be selectively positioned at the different angles to the vertical through an arcuate arm 42, which is fixed to the side member 23 (see FIG. 3) of the sensing frame 21, having a plurality of openings 43 (see FIG. 2) therein to receive a pin 44 (see FIG. 3) therein. The pin 44 bears against the pole 16 to insure that the sensing frame 21 is at the desired angular position when the circular locking elements 39 are tightened.

The side member 24 of the sensing frame 21 has a photoelectric control 50 mounted thereon above the center of the sensing frame 21 and a photoelectric control 51 below the center of the sensing frame 21. One suitable example of each of the photoelectric controls 50 and 51 is sold by Micro Switch, a Honeywell Division, as FE3-R photoelectric control. Any other suitable means for producing a beam of light and reflecting it to a detector may be employed.

The side wall 29 of the sensing frame 21 has openings (not shown) therein for the photoelectric controls 50 and 51 to transmit the beams of light. The beam of light from the photoelectric control 50 is reflected from the side wall 28 of the sensing frame 21 as is the beam of light from the photoelectric control 51.

When a basketball is the propelled object, the photoelectric control 50 is disposed 5½" above the center of the sensing frame 21, and the photoelectric control 51 is disposed 5½" below the center of the sensing frame 21. Thus, an eleven inch window is provided through which the basketball, which has a nine inch diameter, passes. If the basketball is slightly above the desired flight path, it breaks the beam of light from the photoelectric control 50. If the basketball is below the desired flight path, it breaks the light beam produced by the photoelectric control 51.

When the photoelectric control 50 has its light beam broken, a pulse timer 54 (see FIG. 6), which is a monostable multivibrator, is triggered to generate a high output pulse of a constant time duration with the length of the pulse determining the tone duration of a square wave oscillator 55, which is a continuously running astable multivibrator producing a tone of a first frequency. The length of the output pulse from the pulse timer 54 is about 0.5 to 1 second.

When the pulse timer 54 produces a high output pulse, it enables the signal from the oscillator 55 to pass through a NAND gate 56 for transmittal to a NAND gate 57. The NAND gate 57 passes the signal from the oscillator 55 through a filter and amplifier 50 to a speaker 59 and through a filter and amplifier 60 to headphones 61, which may be worn by the shooter.

Figure 5:
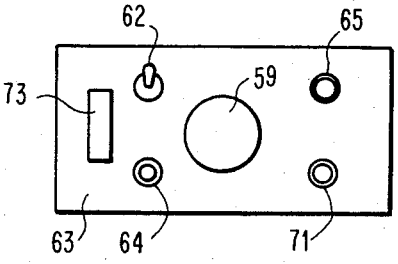
FIG. 5 is a front elevational view of a portion of a panel on the base of the apparatus of FIG. 1.

The speaker 59 is controlled from a switch 62 on a panel 63 (see FIG. 1) on the base 11. The headphones 61 are activated when inserted into a plug 64 (see FIG. 5) on the panel 63.

Figure 6:
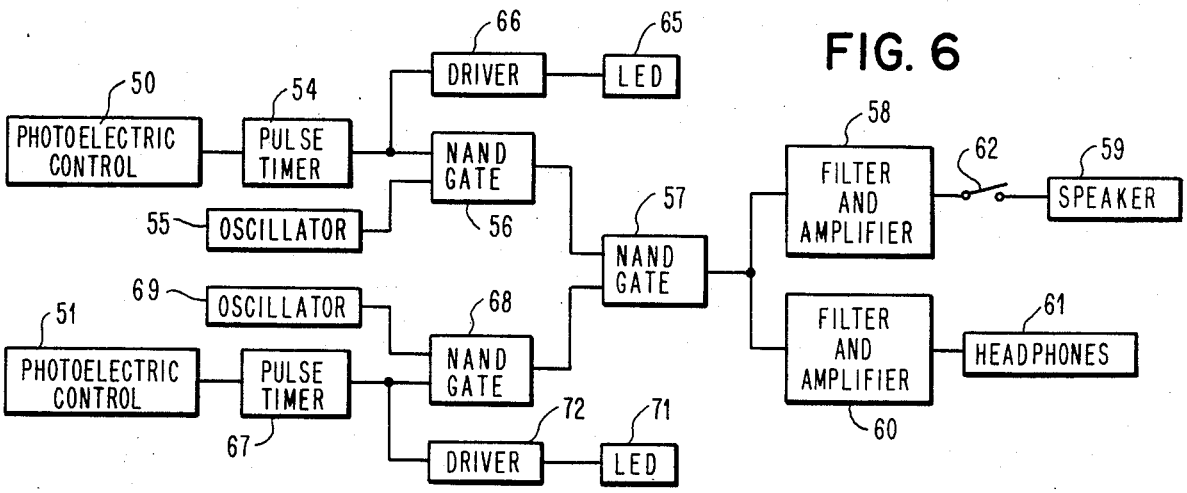
FIG. 6 is a schematic block diagram of an electrical circuit used with the sensing frame to provide signals when the basketball is above or below the desired flight path to the goal.

The pulse from the pulse timer 54 (see FIG. 6) also activates an LED 65, which is mounted on the panel 63 (see FIG. 5) through a driver 66 (see FIG. 6). The LED 65 is a selected color so that the person, who is training the shooter, will know when the LED 65, by its color, is indicating that the path of the trajectory of the basketball is above the desired flight path.

When the basketball is propelled along a trajectory below the desired flight path, the beam of light from the photoelectric control 51 is blocked. This causes a pulse timer 67, which is the same as the pulse timer 54, to produce a positive output pulse of a selected length, which is the same as that produced by the pulse timer 54. The pulse from the pulse timer 67 is supplied to a NAND gate 68 to enable the output of a square wave oscillator 69, which is a continuously running astable multivibrator producing a tone of a second frequency different than the tone of the first frequency from the oscillator 55, to pass its signal through the NAND gate 68 to the NAND gate 57. The supply of the signal from the NAND gate 68 to the NAND gate 57 results in the output of the oscillator 69 being supplied to the speaker 59, if the switch 62 is closed, and to the headphones 61 if they are connected to the headphone plug 64 (see FIG. 5).

The output from the pulse timer 67 (see FIG. 6) also activates an LED 71, which is a different color than the LED 65, to indicate to a person, who is training the shooter, by a visual signal that the trajectory of the basketball was below the desired flight path. The LED 71 receives the signal from the pulse timer 67 through a driver 72.

The panel 63 (see FIG. 5) also has a power switch 73. It is necessary for the power switch 73 to be in an ON position for the electrical circuitry to function.

One suitable example of each of the pulse timers 54 and 67 is a TTL series 74121 timer. One suitable example of each of the square wave oscillators 55 and 69 is a 555 timer. The NAND gates 56, 57, and 68 may be part of a TTL series 7400 NAND gate. One suitable example of each of the audio amplifiers of the filter and amplifier 58 and the filter and amplifier 60 is an audio amplifier sold as LM 380 by National Semiconductor.

Considering the operation of the apparatus 10 (see FIG. 1) in practicing the present invention, the base 11, which is supported on rollers 73 mounted on channels 74 of the base 11 and to which a bottom plate 75 is attached, is positioned in front of the free throw shooter between the free throw shooter and the basketball goal. The base 11 has a pair of handles 76 to enable easy movement of the apparatus 10. The base 11 is positioned initially so that the poles 16 and 17 are about sixteen inches in front of the free throw line behind which the shooter is standing (This disposes the base 11 six inches in front of the free throw line.).

Then, the circular locking elements 39 are loosened so that the sensing frame 21 can be moved vertically. The shooter makes several shots from the same position behind the free throw line. If the signal from the oscillator 55 (see FIG. 6) is produced and the LED 65 is energized, then the sensing frame 21 (see FIG. 1) is raised vertically along the poles 16 and 17 until the LED 71 (see FIG. 6) and the oscillator 69 begin to produce signals when a shot is taken. Next, a slight further downward adjustment of the sensing frame 21 (see FIG. 1) along the poles 16 and 17 is obtained. The sensing frame 21 is locked in this position by tightening the circular locking elements 39.

Prior to tightening the circular locking elements 39, it is necessary to dispose the sensing frame 21 at an angle. This will depend upon the trajectory of the shot from the free throw shooter as it is desired for the sensing frame 21 to be substantially perpendicular to the trajectory of the basketball when it passes through the rectangular shaped opening 30 in the sensing frame 21.

With the sensing frame 21 in the desired position, the free throw shooter shoots the basketball towards a goal 77 (see FIG. 7) with the ball passing through the opening 30 (see FIG. 1) in the sensing frame 21. If a shot is too high, the oscillator 55 (see FIG. 6) produces a tone of a first frequency and the LED 65 is energized. If the trajectory of the shot is too low, then the oscillator 69 produces a tone of a second frequency and the LED 71 is energized to produce a different color than the LED 65. The audio signal from the oscillator 55 or 69 indicates to the shooter whether the trajectory is high or low so that the shooter can make an adjustment in the trajectory. This trajectory feedback to the brain of the shooter is superior to proprioceptive feedback to the brain of the shooter and enhances the ability of the brain of the shooter to fine tune the motor output pattern. This results in improved learning of the performance of the particular motor skill of basketball free throw shooting.

With the player having a height of six feet, the center of the sensing frame 21 (see FIG. 1) is usually located about eight to nine feet above the floor. This is when the base 11 is disposed six inches in front of the free throw line (This is when the poles 16 and 17 are sixteen inches in front of the free throw line.).

The sensing frame 21 is positioned so that the shooter does not see the sensing frame 21 when viewing the goal. Thus, there is no effect on the concentration of the shooter.

While the present invention has shown and described the apparatus 10 as being utilized for training a basketball free throw shooter, it should be understood that it could be utilized for shooting other than free throws as long as the shooter remained in one position although such is not deemed necessary because the improved free throw shooting improves the shooter's capability from other locations. It also could be employed to train a football or baseball player to throw along a desired trajectory. Similarly, it could be utilized to ascertain if a kicker initially kicks a football along a desired flight path. Thus, the apparatus 10 of the present invention may be readily utilized wherever it is desired to train a human to direct an object along a desired path.

An advantage of this invention is that the performance of a motor skill is improved. Another advantage of this invention is that a free throw shooter knows whether the trajectory is too high or too low. A further advantage of this invention is that it can increase the percentage of shooting of a free throw shooter.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A method of improving the learning of a motor skill by identifying a specific, critical parameter of the motor skill of a shooter shooting a basketball along a desired flight path to a basketball goal in which proprioception provides the primary feedback and then enhancing the specificity of this available feedback including:

determining when the specific, critical parameter of the motor skill is satisfactory and not satisfactory with artificial sensors having no contact with the basketball during its movement along the desired flight path;

positioning the artificial sensors and any frame supporting the artificial sensors so that they are not in the field of vision of the shooter when the shooter views the basketball goal to shoot the basketball to the basketball goal and in accordance with the desired flight path as determined by having the shooter shoot the basketball along the desired flight path to the basketball goal;

relaying information by nonproprioceptive channels to the brain from the artificial sensors in accordance with whether the specific, critical parameter of the motor skill of shooting the basketball along the desired flight path to the basketball goal is satisfactory or not satisfactory;

and the relayed information from the artificial sensors including automatically producing a first signal without contact with the basketball when the basketball has moved above the desired flight path by at least a first selected amount at a first selected distance from where the basketball is shot so that the specific, critical parameter of the motor skill is not satisfactory with the first selected distance being substantially prior to the high point of the desired flight path and being such that the velocity of the basketball has a minimum effect on the desired flight path and automatically producing a second signal, different from the first signal, without contact with the basketball when the basketball has moved below the desired flight path by at least a second selected amount at a second selected distance from where the basketball is shot with the second selected distance being substantially prior to the high point of the desired flight path and being such that the velocity of the basketball has a minimum effect on the desired flight path.

2. The method according to claim 1 including:

positioning first signaling means as one of the artificial sensors the first selected amount above the desired flight path at the first selected distance to produce the first signal when the basketball is above the desired flight path by at least the first selected amount at the first selected distance;

positioning second signaling means as another of the artificial sensors the second selected amount below the desired flight path at the second selected distance to produce the second signal when the basketball is below the desired flight path by at least the second selected amount at the second selected distance;

and positioning each of the first signaling means and the second signaling means so that none of the first signaling means, the second signaling means, or any frame on which the first signaling means and the second signaling means are mounted is viewed by the shooter when the shooter views the basketball goal to shoot the basketball to the basketball goal.

3. A method of training a human of any height to shoot a basketball along a desired flight path to a basketball goal while the human looks at the basketball goal including:

determining the desired flight path for the basketball by having the human shoot the basketball along the desired flight path to the basketball goal;

automatically indicating to the human shooting the basketball when the basketball is above the desired flight path by at least a first selected amount at a first selected distance from where the basketball is shot with the first selected distance being substantially prior to the high point of the desired flight path and being such that the velocity of the basketball has a minimum effect on the desired flight path and without any contact with the basketball;

and automatically indicating to the human shooting the basketball when the basketball is below the desired flight path by at least a second selected amount at a second selected distance from where the basketball is shot with the second selected distance being substantially prior to the high point of the desired flight path and being such that the velocity of the basketball has a minimum effect on the desired flight path and without any contact with the basketball.

4. The method according to claim 3 including:

automatically producing a first signal without contact with the basketball to indicate when the shot basketball is above the desired flight path by at least the first selected amount at the first selected distance;

and automatically producing a second signal, different from the first signal, without contact with the basketball to indicate when the shot basketball is below the desired flight path by at least the second selected amount at the second selected distance.

5. The method according to claim 4 including:

positioning first signaling means the first selected amount above the desired flight path at the first selected distance to produce the first signal;

positioning second signaling means the second selected amount below the desired flight path at the second selected distance to produce the second signal;

and positioning each of the first signaling means and the second signaling means so that none of the first signaling means, the second signaling means, or any frame on which the first signaling means and the second signaling means are mounted is within the field of vision of the shooter when the shooter views the basketball goal to shoot the basketball to the basketball goal.

6. An apparatus for training a human of any height to shoot a basketball along a desired flight path to a basketball goal while looking at the basketball goal by indicating when the shot basketball moves above or below the desired flight path including:

first sensing means disposed a first selected amount from the desired flight path at a first selected distance from where the basketball is shot by the shooter with the first selected distance being substantially prior to the high point of the desired flight path and closer to the shooter than to the high point of the desired flight path;

first signaling means to produce a first signal when said first sensing means senses without contact with the shot basketball that the shot basketball is at least the first selected amount above the desired flight path at the first selected distance from where the basketball is shot;

second sensing means disposed a second selected amount below the desired flight path at a second selected distance from where the basketball is shot by the shooter with the second selected distance being substantially prior to the high point of the desired flight path and closer to the shooter than to the high point of the desired flight path;

second signaling means to produce a second signal, different from the first signal, when said second sensing means senses without contact with the shot basketball that the shot basketball is at least the second selected amount below the desired flight path at the second selected distance from where the basketball is shot;

and means to position said first sensing means and said second sensing means out of the field of vision of the shooter when the shooter looks at the basketball goal to shoot the basketball to the basketball goal so that they are not within the field of vision of the shooter when the shooter looks at the basketball goal to shoot the basketball to the basketball goal.

7. The apparatus according to claim 6 including support means to support said first sensing means and said second sensing means.

8. The apparatus according to claim 7 in which said support means includes:

first support means supported on the floor or the like on which the human stands to shoot the basketball;

and second support means adjustably supported on said first support means, said second support means supporting said first sensing means and said second sensing means, said second support means being positioned so that none of said second support means, said first sensing means, and said second sensing means is within the field of vision of the shooter when the shooter views the basketball goal to shoot the basketball to the basketball goal.

9. The apparatus according to claim 8 in which:

said second support means includes means defining an opening larger than the basketball to be shot, said defining means supporting said first sensing means and said second sensing means in spaced relation to each other, said defining means being positioned so that none of said defining means, said first sensing means, and said second sensing means is within the field of vision of the shooter when the shooter views the basketball goal to shoot the basketball to the basketball goal;

said first sensing means includes: means to produce a beam of light across said opening; and means to produce a signal when the beam of light is broken by the basketball passing through said opening to activate said first signaling means;

and said second sensing means includes: means to produce a beam of light across said opening and substantially parallel to the beam of light produced by said beam producing means of said first sensing means;

and means to produce a signal when the beam of light is broken by the basketball passing through said opening to activate said second signaling means.

10. The apparatus according to claim 9 in which said positioning means includes means to mount said defining means on said first support means for both vertical movement and pivotal movement about a substantially horizontal axis so that said defining means may be positioned substantially perpendicular to the desired flight path.

11. The apparatus according to claim 10 in which:

said first support means includes a pair of substantially vertical poles;

each of said poles has a pair of substantially vertical slots formed in diametrical portions thereof;

and said mounting means includes: first means attached to said defining means and extending into said vertical slots in one of said poles;

second means attached to said defining means and extending into said vertical slots in the other of said poles;

each of said first means and said second means being pivotally mounted in said vertical slots to enable pivoting of said defining means about a substantially horizontal axis so that said defining means may be disposed substantially perpendicular to the desired flight path of the basketball;

each of said first means and said second means being vertically movable in said vertical slots to dispose said defining means at various vertical positions;

and means to lock said first means and said second means in any position to which said first means and said second means are moved along said vertical slots in said poles and to which said defining means is pivoted by pivoting of said first means and said second means.

12. The apparatus according to claim 11 including means to hold said defining means in the position to which it is pivoted when said locking means is rendered effective.

13. The apparatus according to claim 9 in which said positioning means includes means to mount said defining means on said first support means for both vertical movement and pivotal movement about a substantially horizontal axis so that said defining means may be positioned at a selected angle to the desired flight path.

14. The apparatus according to claim 13 in which:

said first support means includes a pair of substantially vertical poles;

each of said poles has a pair of substantially vertical slots formed in diametrical portions thereof;

and said mounting means includes:

first means attached to said defining means and extending into said vertical slots in one of said poles;

second means attached to said defining means and extending into said vertical slots in the other of said poles;

each of said first means and said second means being pivotally mounted in said vertical slots to enable pivoting of said defining means about a substantially horizontal axis so that said defining means may be disposed at a selected angle to the desired flight path of the basketball;

each of said first means and said second means being vertically movable in said vertical slots to dispose said defining means at various vertical positions;

and means to lock said first means and said second means in any position to which said first means and said second means are moved along said vertical slots in said poles and to which said defining means is pivoted by pivoting of said first means and said second means.

15. The apparatus according to claim 8 in which said second support means includes means defining an opening larger than the basketball to be shot, said defining means supporting said first sensing means and said second sensing means in spaced relation to each other, said defining means being positioned so that none of said defining means, said first sensing means, and said second sensing means is within the field of vision of the shooter when the shooter views the basketball goal to shoot the basketball to the basketball goal.

16. The apparatus according to claim 15 in which:

said first support means includes vertically disposed means;

and said positioning means includes means to mount said defining means on said vertically disposed means for both vertical movement of said defining means along said vertically disposed means and pivotal movement about a substantially horizontal axis so that said defining means is positioned out of the field of vision of the shooter when the shooter looks at the basketball goal to shoot the basketball to the basketball goal while having said defining means at a selected angle to the desired flight path.

17. The apparatus according to claim 15 in which said positioning means includes means to mount said defining means on said first support means for both vertical movement and pivotal movement about a substantially horizontal axis so that said defining means may be positioned at a selected angle to the desired flight path.

18. The apparatus according to claim 8 in which:

said first sensing means includes: means to produce a beam of light; and means to produce a signal when the beam of light is broken to activate said first signaling means;

and said second sensing means includes: means to produce a beam of light; and means to produce a signal when the beam of light is broken to activate said second signaling means.

19. The apparatus according to claim 7 in which:

said first sensing means includes: means to produce a beam of light; and means to produce a signal when the beam of light is broken to activate said first signaling means;

and said second sensing means includes: means to produce a beam of light; and means to produce a signal when the beam of light is broken to activate said second signaling means.

20. The apparatus according to claim 6 in which:

said first sensing means includes:

means to produce a beam of light;

and means to produce a signal when the beam of light is broken to activate said first signaling means;

and said second sensing means includes:

means to produce a beam of light;

and means to produce a signal when the beam of light is broken to activate said second signaling means.

* * * * *

UNITED STATES PATENT AND TRADEMARK OFFICE

CERTIFICATE OF CORRECTION

PATENT NO. : 4,565,527

DATED : January 21, 1986

INVENTOR(S) : Barry L. Burchett

It is certified that error appears in the above-identified patent and that said Letters Patent is hereby corrected as shown below:

Column 3, line 30, "receives" should read --- receive --- .

Column 4, line 47, "50" should read --- 58 --- .

Column 9, lines 38-50 should read as follows:

--- said first sensing means includes:

means to produce a beam of light across said opening;

and means to produce a signal when the beam of light is broken by the basketball passing through said opening to activate said first signaling means;

and said second sensing means includes:

means to produce a beam of light across said opening and substantially parallel to the beam of light produced by said beam producing means of said first sensing means;

and means to produce a signal when the beam of light is broken by the basketball passing through said opening to activate said second signaling means. --- .

UNITED STATES PATENT AND TRADEMARK OFFICE

CERTIFICATE OF CORRECTION

PATENT NO. : 4,565,527

DATED : January 21, 1986

INVENTOR(S) : Barry L. Burchett

It is certified that error appears in the above-identified patent and that said Letters Patent is hereby corrected as shown below:

Column 9, line 63 to Column 10, line 15 should read as follows:

--- and said mounting means includes:

first means attached to said defining means and extending into said vertical slots in one of said poles;

second means attached to said defining means and extending into said vertical slots in the other of said poles;

each of said first means and said second means being pivotally mounted in said vertical slots to enable pivoting of said defining means about a substantially horizontal axis so that said defining means may be disposed substantially perpendicular to the desired flight path of the basketball;

each of said first means and said second means being vertically movable in said vertical slots to dispose said defining means at various vertical positions;

UNITED STATES PATENT AND TRADEMARK OFFICE

CERTIFICATE OF CORRECTION

PATENT NO. : 4,565,527

DATED : January 21, 1986

INVENTOR(S) : Barry L. Burchett

It is certified that error appears in the above-identified patent and that said Letters Patent is hereby corrected as shown below:

and means to lock said first means and said second means in any position to which said first means and said second means are moved along said vertical slots in said poles and to which said defining means is pivoted by pivoting of said first means and said second means. --- .

Column 11, line 17 to Column 12, line 2 should read as follows:

--- said first sensing means includes:

means to produce a beam of light;

and means to produce a signal when the beam of light is broken to activate said first signaling means;

and said second sensing means includes:

means to produce a beam of light;

and means to produce a signal when the beam of light is broken to activate said second signaling means. --- .

UNITED STATES PATENT AND TRADEMARK OFFICE

CERTIFICATE OF CORRECTION

PATENT NO. : 4,565,527

DATED : January 21, 1986

INVENTOR(S) : Barry L. Burchett

It is certified that error appears in the above-identified patent and that said Letters Patent is hereby corrected as shown below:

Column 12, lines 4-11 should read as follows:

--- said first sensing means includes:

means to produce a beam of light;

and means to produce a signal when the beam of light is broken to activate said first signaling means;

and said second sensing means includes:

means to produce a beam of light;

and means to produce a signal when the beam of light is broken to activate said second signaling means. --- .

Signed and Sealed this

*Twenty-seventh* Day of *May 1986*

[SEAL]

*Attest:*

DONALD J. QUIGG

*Attesting Officer*

*Commissioner of Patents and Trademarks*